US009007292B2

(12) United States Patent
Ikari et al.

(10) Patent No.: US 9,007,292 B2
(45) Date of Patent: Apr. 14, 2015

(54) DRIVER CIRCUIT AND DRIVER CELL GENERATING DRIVE SIGNAL FOR DISPLAY PANEL

(75) Inventors: Junko Ikari, Kanagawa (JP); Hideaki Hasegawa, Ibaraki (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 198 days.

(21) Appl. No.: 13/432,853

(22) Filed: Mar. 28, 2012

(65) Prior Publication Data

US 2012/0249608 A1 Oct. 4, 2012

(30) Foreign Application Priority Data

Mar. 31, 2011 (JP) ..... 2011-078963

(51) Int. Cl.
*G09G 3/36* (2006.01)
*G09G 3/20* (2006.01)

(52) U.S. Cl.
CPC ..... *G09G 3/20* (2013.01); *G09G 3/3685* (2013.01); *G09G 2300/0426* (2013.01); *G09G 2310/027* (2013.01); *G09G 2320/0223* (2013.01); *G09G 2320/0233* (2013.01)

(58) Field of Classification Search
USPC ..... 345/87–104, 211–213; 348/86, 87; 349/151, 152; 438/36, 734
See application file for complete search history.

(56) References Cited

U.S. PATENT DOCUMENTS 5,523,772 A * 6/1996 Lee ..... 345/98
5,995,073 A 11/1999 Isami et al.
6,806,859 B1 10/2004 Kanoh et al.
2004/0179027 A1* 9/2004 Nakai et al. ..... 345/690
2005/0151714 A1* 7/2005 Hirama ..... 345/100
2005/0219195 A1* 10/2005 Yano et al. ..... 345/100
2006/0197734 A1* 9/2006 Morita ..... 345/100
2007/0152947 A1* 7/2007 Tanaka et al. ..... 345/100
2007/0195053 A1* 8/2007 Tobita et al. ..... 345/100

(Continued)

FOREIGN PATENT DOCUMENTS

JP H09-026765 A 1/1997
JP H09-281930 A 10/1997

(Continued)

OTHER PUBLICATIONS

An Office Action; "Notice of Reason for Rejection," issued by the Japanese Patent Office on Dec. 24, 2014, which corresponds to Japanese Patent Application No. 2011-078963 and is related to U.S. Appl. No. 13/432,853; with English language partial translation.

*Primary Examiner* — Sanghyuk Park
(74) *Attorney, Agent, or Firm* — Studebaker & Brackett PC

(57) ABSTRACT

A driver circuit for driving a display panel is formed on a substrate and is organized into two families of sections. Each section includes a logic circuit, a level shifter, a decoder, an operational amplifier, and an output pad. In the first family, each section is laid out in the stated sequence (logic circuit, level shifter, decoder, operational amplifier, output pad). In the second family, each section is laid out in a different sequence: output pad, operational amplifier, logic circuit, level shifter, decoder. The output pads in the two families of sections are located on opposite sides of the substrate, and every output pad is adjacent to the operational amplifier to which it is connected. This arrangement reduces signal-to-signal variations in the output characteristics of the driver circuit and improves the slew rate of the output signals.

14 Claims, 6 Drawing Sheets

(56) References Cited

U.S. PATENT DOCUMENTS

| | | | | |
|---|---|---|---|---|
| 2007/0229440 | A1* | 10/2007 | Yen | 345/100 |
| 2010/0013869 | A1* | 1/2010 | Matsumoto | 345/690 |
| 2011/0007065 | A1* | 1/2011 | Tanaka et al. | 345/213 |

FOREIGN PATENT DOCUMENTS

| | | | |
|---|---|---|---|
| JP | 2009-020511 | A | 1/2009 |
| JP | 2009-059957 | A | 3/2009 |
| JP | 2009-253374 | A | 10/2009 |

* cited by examiner

DRIVER CIRCUIT AND DRIVER CELL GENERATING DRIVE SIGNAL FOR DISPLAY PANEL

BACKGROUND OF THE INVENTION

1. Field of the Invention

The present invention relates to a driver circuit and driver cell for a display device.

2. Description of the Related Art

A driver circuit for a display device is generally formed as an integrated circuit chip. The chip is sometimes referred to as a source driver because it is connected to the source terminals of transistors in the display panel of the display device.

FIG. 1 shows a conventional source driver chip 10. The chip includes logic circuits 11, level shifters 13, decoders 13, operational amplifiers (OP-AMPs) 14, output pads 15, and one or more ladders 18 formed on a rectangular chip substrate 16. Responsive to input of an image data signal, the logic circuits 11, level shifters 13, decoders 13, and operational amplifiers 14 select voltages generated by the ladders 18 to generate voltage signals representing the gradation levels of pixels in the image.

The logic circuits 11, level shifters 13, decoders 13, and operational amplifiers 14 are conventionally laid out in the order shown, with the logic circuits 11 near one long side 16A of the chip substrate 16 and the operational amplifiers 14 near the opposite long side 16B. The output pads 15 are formed on both long sides 16A, 16B of the substrate. Descriptions of driver circuits of this type can be found in, for example, Japanese Patent Application Publications No. 2009-59957 and 2009-253374.

FIG. 2 shows an enlarged view of a conventional driver circuit, showing the part encircled by the dotted line X in FIG. 1. There is one logic circuit 11, one level shifter 12, one decoder 13, one operational amplifier 14, and one output pad 15 for each column of pixels in the display panel. That is, there is one output signal channel for each column of pixels. The logic circuit 11, level shifter 12, decoder 13, and operational amplifier 14 for one channel constitute a driver cell. The arrows in FIG. 2 indicate the flow of input data through the driver cells.

The driver cells for two channels are normally formed as a single circuit group. FIG. 2 shows two such circuit groups A and B. The output pads 15 of adjacent circuit groups are disposed on opposite sides of the chip substrate 16. In FIG. 2 the output pads 15 of circuit group A are on side 16A and the output pads 15 of circuit group B are on side 16B.

The operational amplifiers 14 are connected to the output pads 15 by metal wiring patterns 17A, 17B. Metal wiring patterns 17B extend from the operational amplifiers 14 in circuit group B to output pads 15 on the adjacent side 16B, but metal wiring patterns 17A must make lengthy detours around circuits 11-14 to reach the output pads 15 on the opposite side 16A.

A problem with the arrangement shown in FIG. 2 is that since the length of the metal wiring patterns connecting the operational amplifiers to the output pads differs from channel to channel, the output characteristics of the channels are non-uniform. A particular problem is that the wiring resistance in the long metal wiring patterns 17A adversely affects the slew rate of the signals output from circuit group A.

SUMMARY OF THE INVENTION

An object of the present invention is to reduce channel-to-channel variations in the output characteristics of a driver circuit for a display device.

Another object is to improve the slew rate of the output signals of the driver circuit.

The invention provides a novel driver circuit for receiving input image data and generating a plurality of drive signals for a display panel. The driver circuit is formed on a substrate and is organized into a plurality of sections. Each section includes a logic circuit for obtaining a digital value from the input image data and outputting a corresponding first digital signal, a level shifter for performing a level conversion operation on the first digital signal to obtain a second digital signal, a decoder for decoding the second digital signal to obtain a first voltage signal representing a pixel intensity gradation, an operational amplifier for converting the first voltage signal to a second voltage signal representing the pixel intensity gradation, and an output pad for output of the second voltage signal. The second voltage signal has a lower output impedance than the first voltage signal.

The plurality of sections includes a first family of sections and a second family of sections. In the first family, each section is laid out in a first spatial sequence in a first direction on the substrate. The first spatial sequence begins with the logic circuit, continues sequentially through the level shifter, the decoder, and the operational amplifier, and ends with the output pad. In the second family, each section is laid out in a second spatial sequence in the first direction. The second spatial sequence begins with the output pad, continues sequentially through the operational amplifier, the logic circuit, and the level shifter, and ends with the decoder. At least one section in the first family and at least one section in the second family are mutually adjacent.

In both sequences each operational amplifier is connected to a spatially adjacent output pad. The driver circuit can therefore be designed so that all of the metal interconnection patterns are of substantially the same length, reducing channel-to-channel variations in the output characteristics, and all of the metal interconnection patterns are short, improving the slew rate of the output signals.

The invention also provides a novel driver cell including a logic circuit, a level shifter, a decoder, and an operational amplifier as described above. The logic circuit, level shifter, and decoder occupy respective rectangular areas of a first width. The operational amplifier occupies a rectangular area of a second width greater than the first width.

The novel driver cell provides extra space for the large output transistors in the operational amplifier and permits a space efficient layout of driver cells.

DETAILED DESCRIPTION OF THE INVENTION

Figure 1:
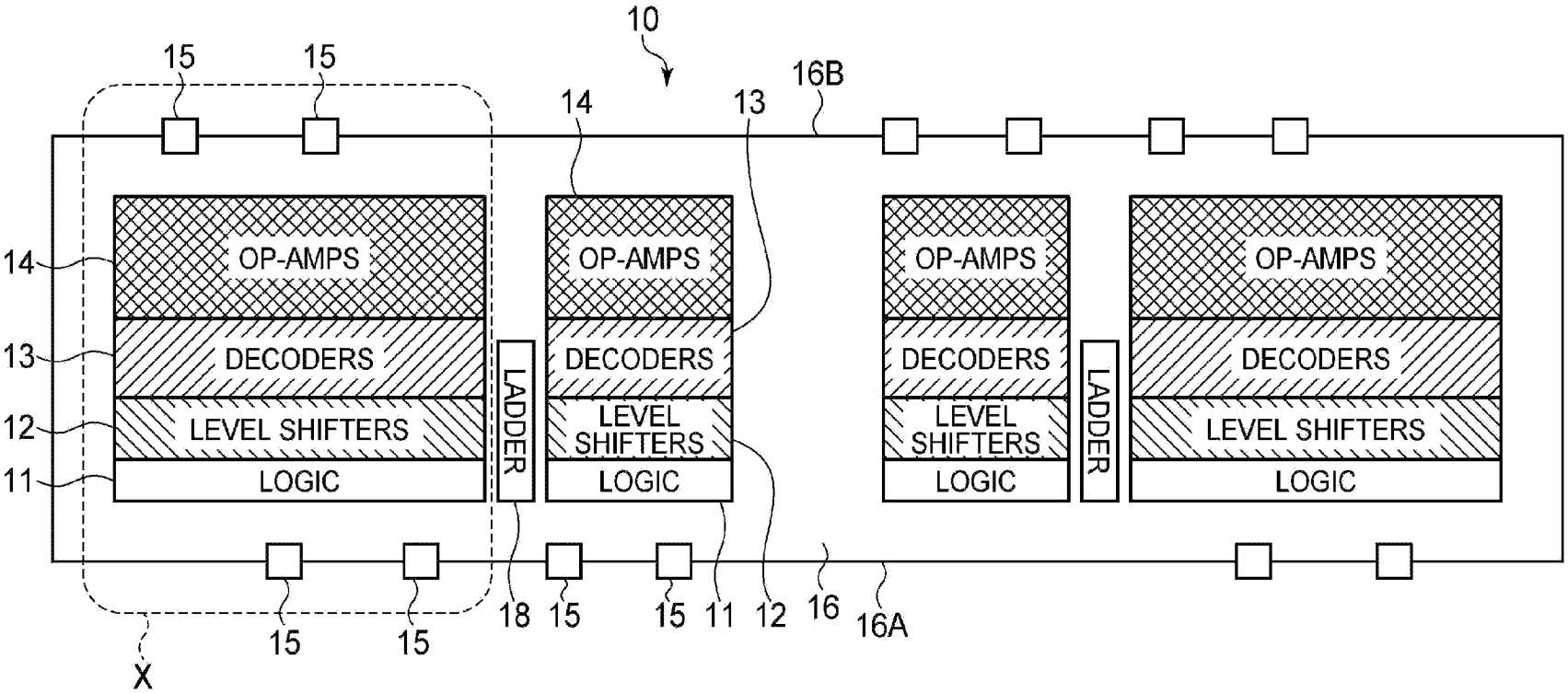
FIG.1 PRIOR ART
FIG. 1 shows the circuit layout of a conventional driver circuit chip for a display device.

Novel driver circuits will now be described with reference to FIGS. 3 to 6, in which like elements are indicated by like reference characters.

Figure 3:
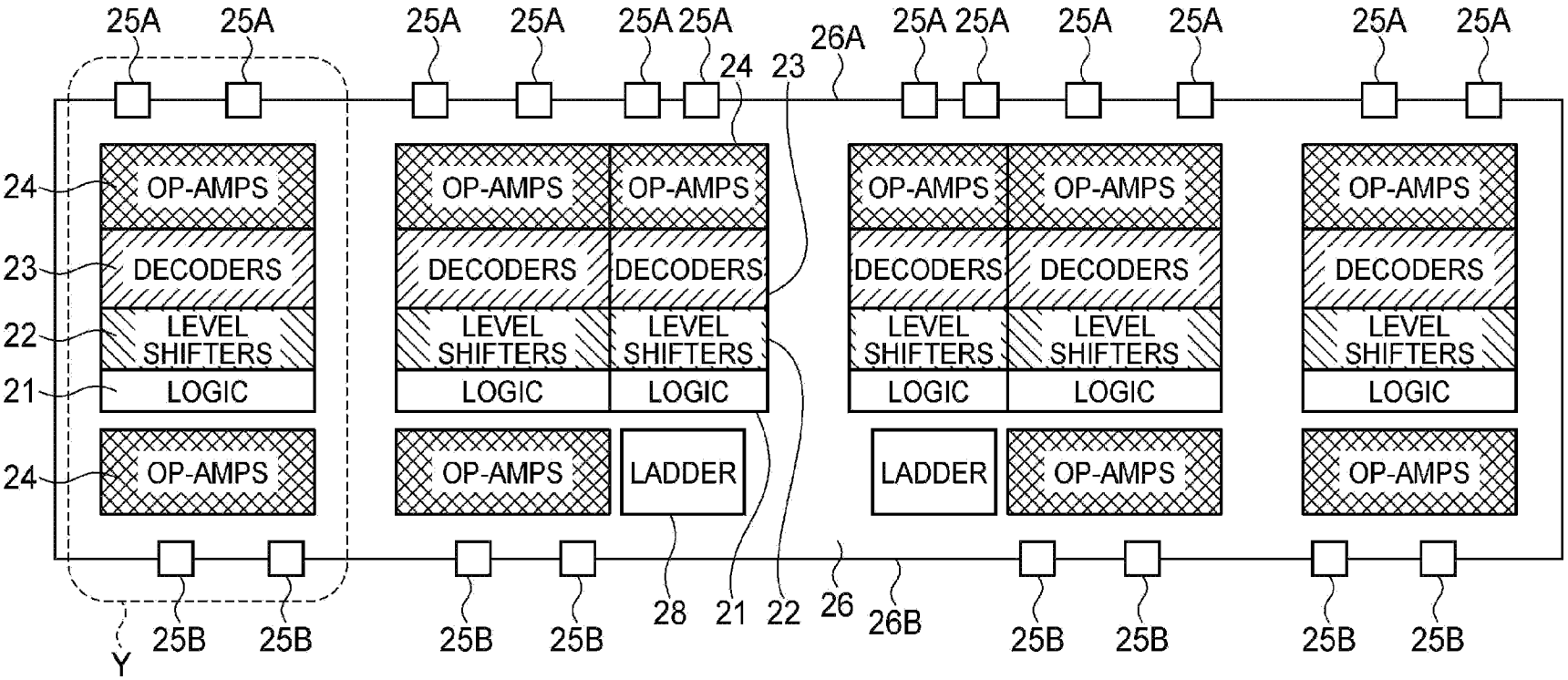
FIG. 3 shows the circuit layout of a novel driver circuit chip for a display device.

Referring to FIG. 3, an exemplary novel driver circuit includes logic circuits 21, level shifters 23, decoders 23, operational amplifiers 24, and output pads 25A, 25B formed on a rectangular semiconductor chip substrate 26 having two long sides 26A, 26B. Output pads 25A are disposed on the first long side 26A. Output pads 25B are disposed on the second long side 26B. A difference between this driver circuit and the conventional driver circuit 10 in FIG. 1 is that the operational amplifiers 24 are formed adjacent both long sides 26A, 26B.

The driver circuit also includes ladders 28 that supply selectable voltage signals representing possible pixel gradations on the display panel (not shown) driven by the driver circuit. The display panel may be, for example, a liquid crystal display panel. Each ladder 28 may be configured as a series of resistors that divide a supplied voltage to generate the gradation voltages.

Although the same terminology as in the background art is used herein to describe the components of the driver chip (logic circuits, level shifters, decoders, operational amplifiers, output pads), it will be appreciated that the same or equivalent circuit elements may be designated by different names, and that the invention is not limited to any particular terminology.

Figure 4:
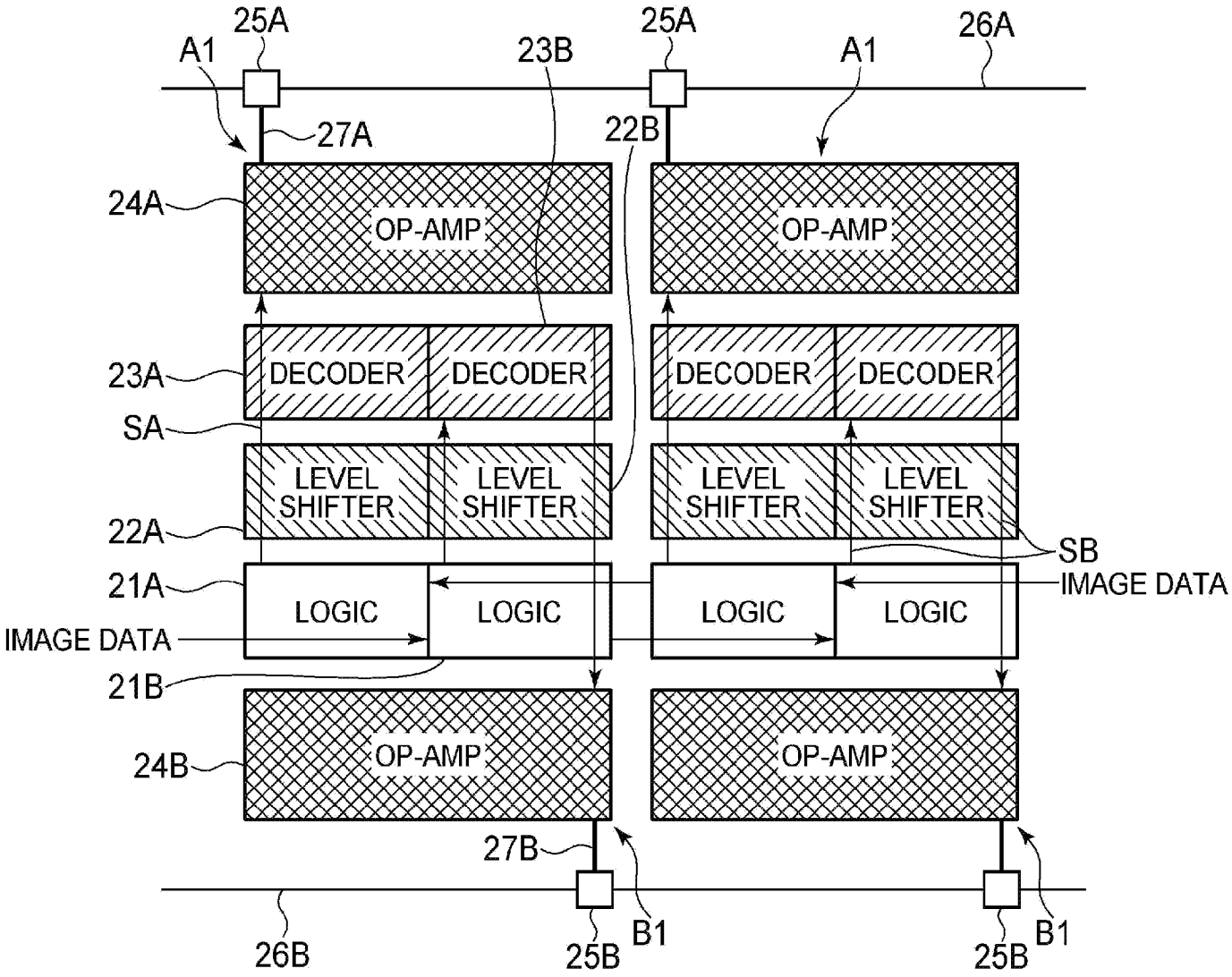
FIG. 4 shows an enlarged view of part Y in FIG. 3.

The part of the driver circuit enclosed in the dotted line Y, including four driver cells and their output pads, as shown in more detail in FIG. 4.

The first driver cell includes logic circuit 21A, level shifter 22A, decoder 23A, and operational amplifier 24A. Operational amplifier 24A is disposed between decoder 23A and an output pad 25A on long side 26A, and is connected to this output pad 25A. The layout sequence, proceeding in the vertically upward direction in the drawing, begins with logic circuit 21A, continues sequentially through level shifter 22A, decoder 23A, and operational amplifier 24A, and ends with the output pad 25A.

The second driver cell includes logic circuit 21B, level shifter 22B, decoder 23B, and operational amplifier 24B. Operational amplifier 24A is disposed between logic circuit 21B and an output pad 25B on long side 26B, and is connected to this output pad 25B. The layout sequence, proceeding in the vertically upward direction in the drawing, begins with the output pad 25B, continues sequentially through operational amplifier 24B, logic circuit 21B, and level shifter 22B, and ends with decoder 23B.

The other driver cells have similar layouts, cells in which the operational amplifier is adjacent side 26A alternating with cells in which the operational amplifier is adjacent side 26B. In each cell, the logic circuit, level shifter, and decoder are laid out in mutually aligned rectangular areas of equal width. The operational amplifier occupies a rectangular area of twice this width. Each operational amplifier is aligned with the logic circuits, level shifters, and decoders in two mutually adjacent driver cells.

Operational amplifier 24A is connected to adjacent output pad 25A by a metal wiring pattern 27A. Operational amplifier 24B is connected to adjacent output pad 25B by a metal wiring pattern 27B. These two metal wiring patterns 27A, 27B are both short and are of substantially equal length.

The driver circuit can be divided into sections, each section including one driver cell and its connected output pad. The sections can be grouped into two families. The sections A1 in the first family have operational amplifiers 24A and output pads 25A disposed adjacent side 26A of the chip substrate 26. The sections B1 in the second family have operational amplifiers 24B and output pads 25B disposed adjacent side 26B. The sections A1 in the first family alternate with the sections B1 in the second family in the horizontal direction in FIG. 4. The logic circuits in all the driver cells are aligned in a single horizontal row. Similarly, the level shifters in all the driver cells are aligned in a single horizontal row, and the decoders in all the driver cells are aligned in a single horizontal row.

The logic circuits 21A, 21B obtain digital values (eight-bit signals, for example) from input image data. The input image data signal is synchronized with a clock signal and follows a route that, for example, passes first through the logic circuits 21A in the first family of sections A1 and then returns through the logic circuits 21B in the second family of sections B1, as indicated by the horizontal arrows. Each logic circuit extracts the digital value representing one pixel of the image to be displayed, and outputs it as a digital signal.

The level shifters 22A, 22B perform a voltage level conversion operation on each bit of the digital signals output by the logic circuits 21A, 21B and output the converted digital signals.

The decoders 23A, 23B decode the converted digital signals in order to select corresponding voltage signals generated by the ladders 28 in FIG. 3, and output corresponding voltage signals representing the gradation levels of pixels in the image to be displayed. These voltage signals have a comparatively high output impedance, suitable for the high input impedance of the operational amplifiers 24A, 24B.

The operational amplifiers 24A, 24B convert the high-impedance voltage signals from the decoders to low-impedance signals that can be used to drive the display panel. The operation amplifiers 24A, 24B may be configured as voltage followers. The low-impedance voltage signals are output from the output pads 25A, 25B.

The signal flow from the logic circuits 21A to the operational amplifiers 24A in the first family of sections A1 is straight upward in FIG. 4, as indicated by arrow SA. In the second family of sections B1, however, the signal flow includes both an upward segment from the logic circuits 21B to the decoders 23B and a downward segment from the decoders 23B to the operational amplifiers 24B, as indicated by arrows SB. In the downward segment from the decoders 23B to the operational amplifiers 24B, the voltage signals output by the decoders 23B are routed straight through the level shifters 22B and logic circuits 21B in the same driver cell, without making detours outside the cell.

The extra interconnection length between the decoders 23B and operational amplifiers 24B in the second family of sections B1 has some effect on the output characteristics of the second family of sections B1. The high input impedance of the operational amplifiers 24B and the lack of detours minimizes this effect, however, so it is much less than the effect of the conventional roundabout metal wiring patterns 17A in FIG. 2.

One advantage of the circuit layout in FIG. 4 is that the short length of the metal wiring patterns connecting the operational amplifiers 24A, 24B to the output pads 25A, 25B improves the slew rate of the output voltage signals of the chip.

Another advantage is that the substantially uniform length of the metal wiring patterns connecting the operational amplifiers 24A, 24B to the output pads 25A, 25B reduces channel-to-channel variations in the output characteristics of the chip.

Another advantage is that the extra width allotted to the operational amplifiers 24A, 24B, which have comparatively large output transistors, enables space on the chip to be used efficiently, so that the size of the chip can be reduced. The lack of wiring detours also contributes to space efficiency and reduced chip size.

Figure 5:
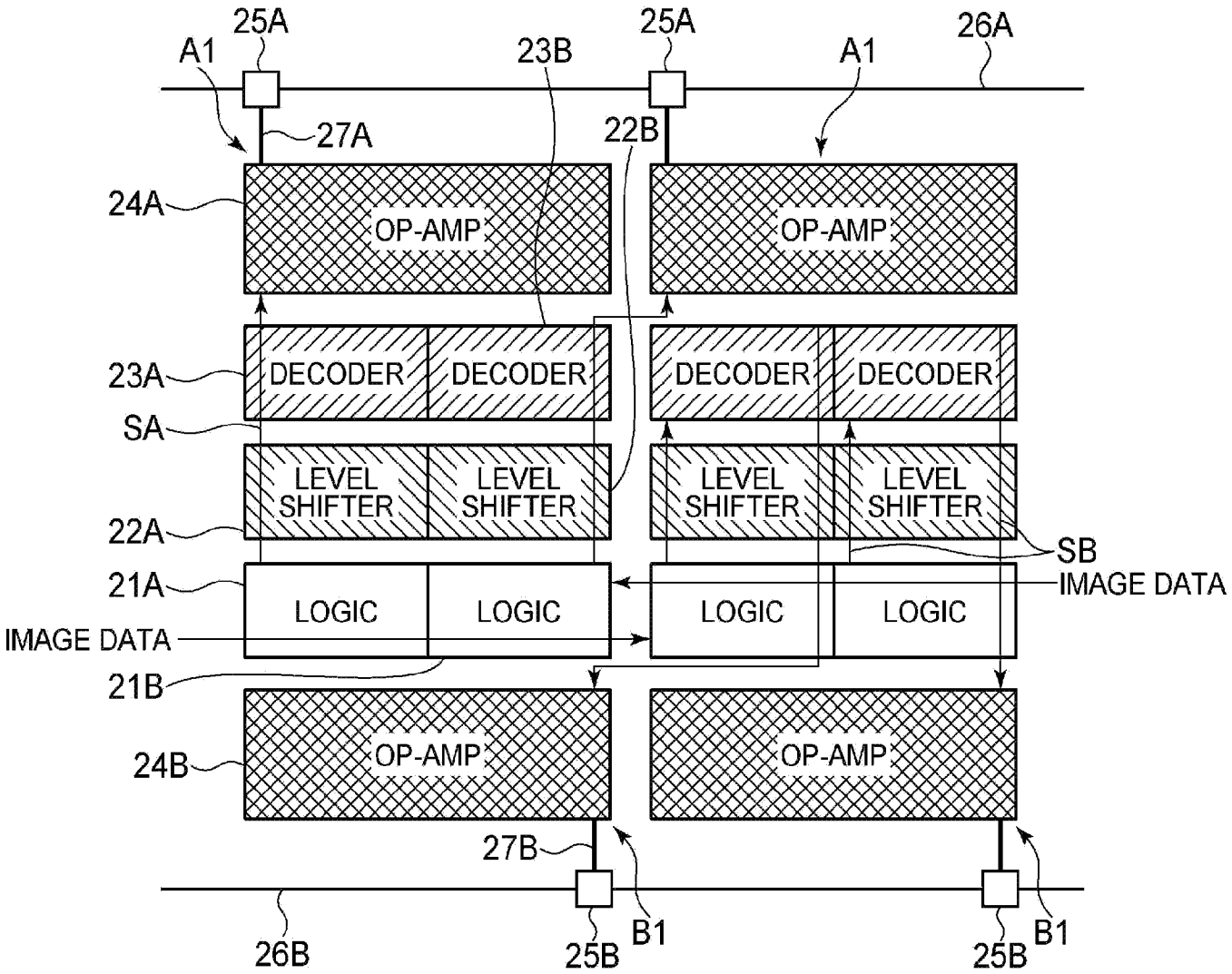
FIG. 5 shows a variation of the internal data paths in FIG. 4.

FIG. 5 shows a variation of the layout in FIG. 4 in which two driver cells in the first family of sections A1 are laid out side by side, and two driver cells in the second family of sections B1 are laid out side by side. In the horizontal direction, pairs of sections A1 in the first family alternate with pairs of sections B1 in the second family.

Figure 6:
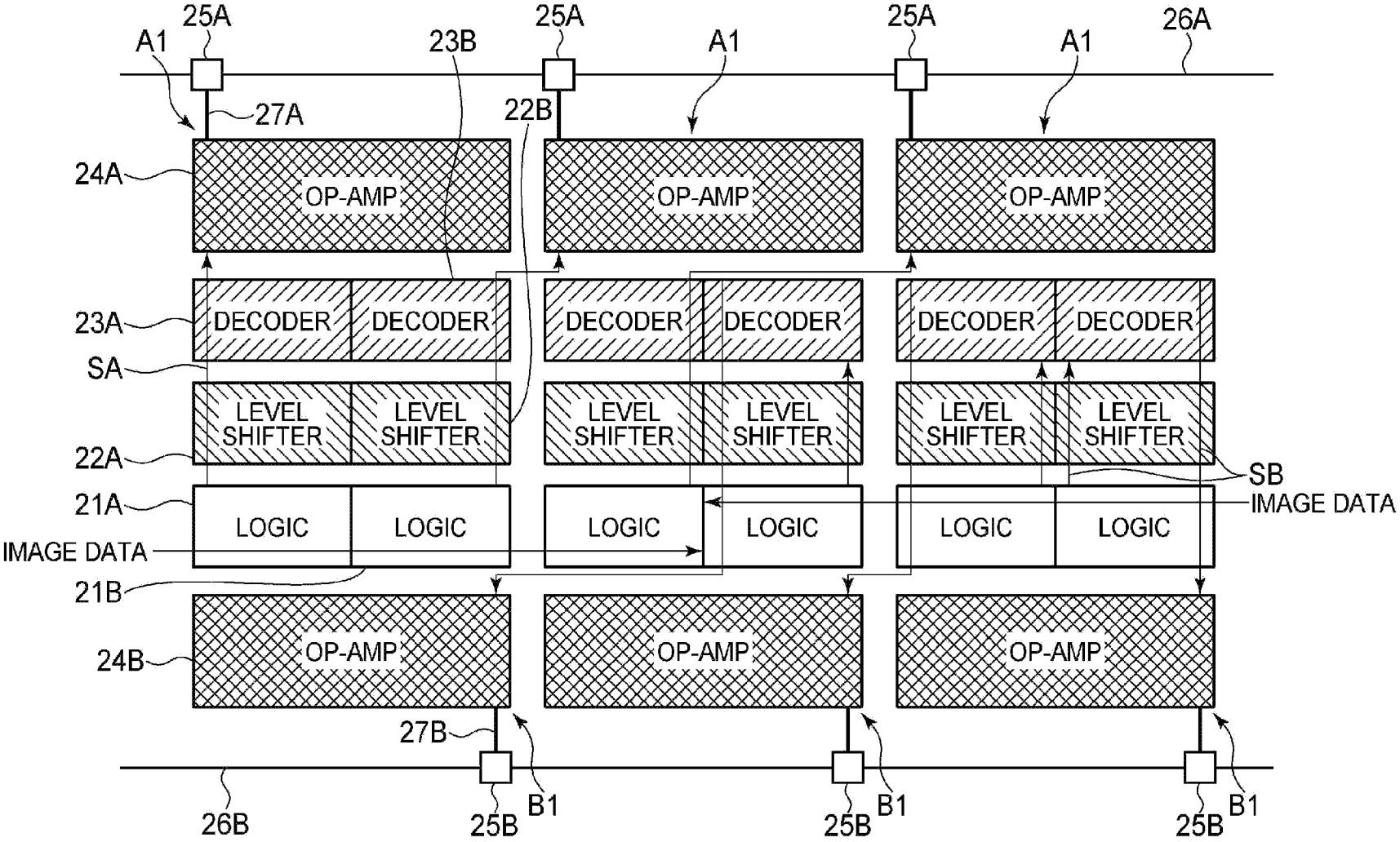
FIG. 6 shows another variation of the internal data paths in FIG. 4.

FIG. 6 shows another variation of the layout in FIG. 4 in which three driver cells in the first family of sections A1 are laid out side by side, and three driver cells in the second family of sections B1 are laid out side by side. In the horizontal direction, triplets of sections A1 in the first family alternate with triplets of section B1 in the second family.

In the general case, N sections A1 in the first family may alternate with N section B1 in the second family, where N is any positive integer.

Figure 2:
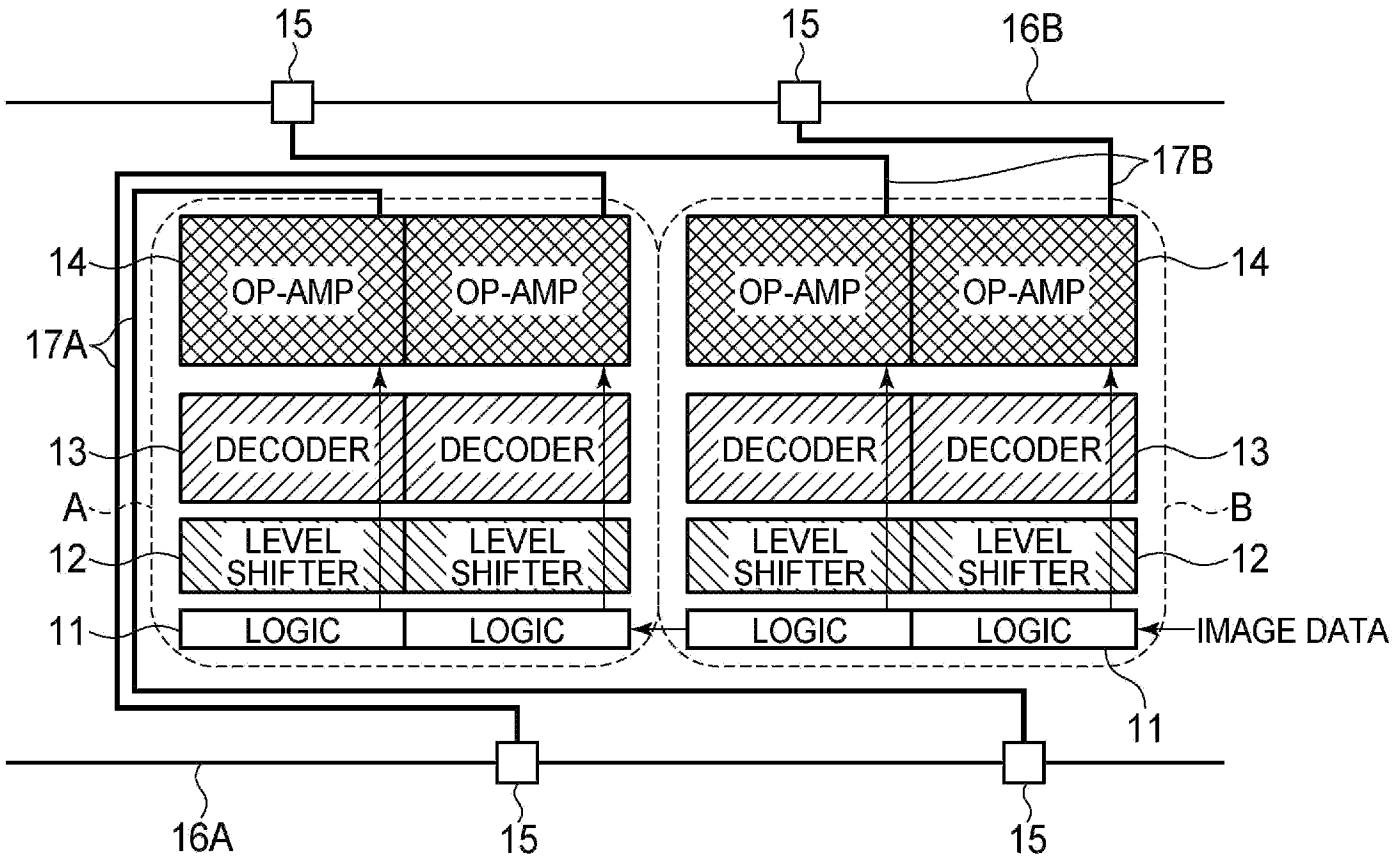
FIG.2 PRIOR ART
FIG. 2 shows an enlarged view of part X in FIG. 1.

The novel circuit configuration shown in any of FIGS. 3 to 6 and the conventional circuit configuration shown in FIGS. 1 and 2 may both be used in the same driver chip.

The novel circuit configuration shown in any of FIGS. 3 to 6 may also be used in a driver circuit in which the logic circuits, level shifters, decoders, and operational amplifiers are separate integrated circuits and the substrate is a printed circuit board.

Those skilled in the art will recognize that further variations are possible within the scope of the invention, which is defined in the appended claims.

What is claimed is:

1. A driver circuit for receiving input image data and generating a plurality of drive signals for a display panel, the driver circuit being formed on a substrate, the driver circuit being organized into a plurality of sections, each section including a logic circuit for obtaining a digital value from the input image data and outputting a corresponding first digital signal, a level shifter for performing a level conversion operation on the first digital signal to obtain a second digital signal, a decoder for decoding the second digital signal to obtain a first voltage signal representing a pixel intensity gradation, an operational amplifier for converting the first voltage signal to a second voltage signal representing the pixel intensity gradation, and an output pad for output of the second voltage signal, the second voltage signal having a lower output impedance than the first voltage signal, wherein:

the plurality of sections includes a first family of sections and a second family of sections;

in the first family, each section is laid out in a first spatial sequence in a first direction on the substrate;

the first spatial sequence begins with the logic circuit, continues sequentially through the level shifter, the decoder, and the operational amplifier, and ends with the output pad;

in the second family, each section is laid out in a second spatial sequence in the first direction on the substrate;

the second spatial sequence begins with the output pad, continues sequentially through the operational amplifier, the logic circuit, and the level shifter, and ends with the decoder; and at least one section in the first family and at least one section in the second family are mutually adjacent.

2. The driver circuit of claim 1 wherein, in each section in the second family, the decoder and the operational amplifier are interconnected by a signal line extending through the logic circuit and the level shifter.

3. The driver circuit of claim 1, wherein the substrate has a rectangular shape with a first long side and a second long side, the first direction extends from the second long side to the first long side, the output pads of the sections in the first family are disposed on the first long side, and the output pads of the sections in the second family are disposed on the second long side.

4. The driver circuit of claim 1, wherein sets of N sections in the first family alternate with sets of N sections in the second family in a second direction differing from the first direction, N being a positive integer.

5. The driver circuit of claim 4, wherein N is equal to one.

6. The driver circuit of claim 4, wherein N is equal to two.

7. The driver circuit of claim 4, wherein N is equal to three.

8. The driver circuit of claim 4, wherein the second direction is orthogonal to the first direction.

9. The driver circuit of claim 4, wherein the logic circuits in all the sections are mutually aligned in the second direction.

10. The driver circuit of claim 1, wherein the logic circuit, the level shifter, the decoder, and the operational amplifier in each section are formed as integrated circuits on the substrate.

11. The driver circuit of claim 10, wherein the substrate is a semiconductor substrate.

12. The driver circuit of claim 1, wherein in each section in the plurality of sections, the logic circuit, the level shifter, and the decoder occupy respective rectangular areas having a first width, and the operational amplifier occupies a rectangular area having a second width greater than the first width.

13. The driver circuit of claim 12, wherein the second width is substantially twice the first width.

14. The driver circuit of claim 12, wherein the first and second widths are orthogonal to the first direction.

* * * * *